US006637309B2

(12) United States Patent
See et al.

(10) Patent No.: US 6,637,309 B2
(45) **Date of Patent: *Oct. 28, 2003**

(54) LAUNCH TUBE AND A METHOD FOR MAKING A LAUNCH TUBE

(75) Inventors: Samuel A. See, Goodrich, TX (US); Goran L. F. Haag, Spring, TX (US)

(73) Assignee: Champion Fiberglass, Inc., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/157,469

(22) Filed: May 29, 2002

(65) Prior Publication Data

US 2002/0139240 A1 Oct. 3, 2002

Related U.S. Application Data

(63) Continuation-in-part of application No. 09/961,478, filed on Sep. 24, 2001, and a continuation of application No. 09/419,839, filed on Oct. 15, 1999, now Pat. No. 6,293,178.

(51) Int. Cl.[7] ..... F41A 21/00
(52) U.S. Cl. ..... 89/16
(58) Field of Search ..... 89/16, 1.81; 220/801; 124/48, 59; 102/361, 49.7, 323, 333, 335; 493/48, 308

(56) References Cited

U.S. PATENT DOCUMENTS

| | | | | |
|---|---|---|---|---|
| 1,922,081 | A | | 8/1933 | Driggs |
| 2,687,228 | A | * | 8/1954 | Knocke |
| 3,068,756 | A | | 12/1962 | Schermuly |
| 4,049,151 | A | | 9/1977 | Schweiso |
| 4,494,670 | A | | 1/1985 | Barone |
| 4,733,597 | A | | 3/1988 | Upham |
| 4,791,870 | A | | 12/1988 | Simpson |
| 5,076,134 | A | | 12/1991 | Marshall et al. |
| 5,109,750 | A | | 5/1992 | Kayaian |
| 5,149,290 | A | | 9/1992 | Reveen |
| 5,160,226 | A | | 11/1992 | Lee, II |
| 5,316,414 | A | | 5/1994 | Wright |
| 5,623,113 | A | | 4/1997 | Valembois |
| 5,627,338 | A | | 5/1997 | Poor et al. |
| 5,803,791 | A | | 9/1998 | Chiles |
| 6,293,178 | B1 | | 9/2001 | See |
| 6,318,461 | B1 | | 11/2001 | Carisella |
| 6,325,943 | B1 | | 12/2001 | Kohlenberg |

OTHER PUBLICATIONS

Jet Moulding Compounds—Custom Formulated Pigmented SMC, BMC, and LPMC, http://www.jetmoulding.com/html/product.html (Dec. 7, 2001).

Jet Moulding Compounds—Product Specifications (SMC), http://www.jetmoulding.com/html/data.html (Dec. 7, 2001).

* cited by examiner

*Primary Examiner*—Michael J. Carone
*Assistant Examiner*—Troy Chambers
(74) *Attorney, Agent, or Firm*—Akin Gump Strauss Hauer & Feld LLP

(57) ABSTRACT

A launch tube made using fiberglass reinforced polymer (FRP) includes a FRP tube having an inside wall, where the inside wall has a groove near a lower end of the tube. A bottom made of FRP is molded for engagement with the tube at the groove. After forming the tube with the groove, a mold is placed inside the tube adjacent to the groove, and resin-coated fiberglass matting is laid on the mold. A fibrous material is placed over the fiberglass matting and a nonporous bag seals the fiberglass matting. A vacuum is drawn in the bag, and atmospheric air pressure compresses the fiberglass matting, forcing it into the groove. A counter-mold can be used instead of vacuum setting to compress the fiberglass matting. A compound, such as Sheet Molding Compound (SMC), Bulk Molding Compound (BMC) or Low Pressure Molding Compound (LPMC) is applied between the mold and counter-mold presses. Pressure and temperature are applied to the mold and counter-mold to position the bottom with the tube. The bottom has a convex surface, and the convex surface and the inside wall of the tube define a chamber for receiving explosive propellants.

24 Claims, 2 Drawing Sheets

LAUNCH TUBE AND A METHOD FOR MAKING A LAUNCH TUBE

CROSS-REFERENCE TO RELATED APPLICATIONS

This application is a continuation-in-part application of pending application Ser. No. 09/961,478, filed on Sep. 24, 2001, entitled PYROTECHNIC LAUNCH TUBE, said pending application Ser. No. 09/961,478, is a continuation application of application Ser. No. 09/419,839, filed on Oct. 15, 1999, entitled PYROTECHNIC LAUNCH TUBE, said '839 application has issued into U.S. Pat. No. 6,293,178, on Sep. 25, 2001.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

This invention pertains to launch tubes, and particularly to a launch tube made using fiberglass reinforced polymer (FRP).

2. Description of the Related Art

A fiberglass reinforced polymer (FRP) launch tube has been made, where a bottom is formed by bonding or gluing a plug inside the tube. However, the force from the explosion of pyrotechnics or other explosive propellants inside the tube can break the adhesive bond between the bottom and the inside wall of the tube. The launch tube must then be repaired or replaced.

BRIEF SUMMARY OF THE INVENTION

A method has been devised for making a fiberglass reinforced polymer (FRP) launch tube that can better withstand the explosive force of pyrotechnics or other explosive propellants. An FRP tube is made, and a groove is formed inside the tube adjacent one end. A bottom is engaged with the groove so that axial forces during the explosion are transmitted to the tube. Thus, rather than relying on the bond strength of an adhesive to hold a bottom, the bottom is instead engaged with the FRP tube by its extension into the circumferential groove.

The launch tube may be formed by positioning a mold inside the launch tube adjacent the groove and molding FRP to form the bottom. Such molding may include a compound such as Sheet Molding Compound (SMC), Bulk Molding Compound (BMC) or Low Pressure Molding Compound (LPMC).

A molding resin can be laid on the mold and compressed or vacuum set to squeeze the fiberglass and resin into the groove. Alternatively, a bottom can be pressed into the tube, where the bottom compresses and then expands into the groove. The bottom and the tube form a chamber for receiving pyrotechnics or explosive propellants, and the bottom preferably has a convex surface for defining the chamber. In this manner, explosive forces press the bottom into tighter or deeper engagement with the tube groove.

A launch tube made according to such methods is thus better able to withstand the explosive forces as pyrotechnics or explosive propellants are discharged from the tube.

DETAILED DESCRIPTION OF THE INVENTION

Figure 1:
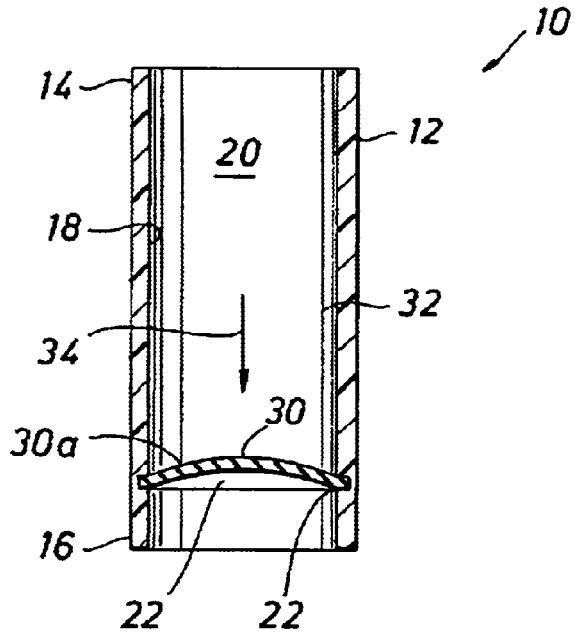
FIG. 1 is a cross section of a launch tube, according to the present invention.

FIG. 1 shows a fiberglass reinforced polymer (FRP) pyrotechnic launch tube 10 in cross section. Launch tube 10 preferably comprises a cylindrical tube 12, which is formed by conventional means of wrapping resin-coated strands of fiberglass around a mandrel; curing the resin; and removing the mandrel. Tube 12 has an upper end 14, a lower end 16 and an inside or inner wall 18. Inside wall 18 has a cylindrical surface 20. A slot, such as groove 22, is formed in inner wall 18 near lower end 16.

Groove 22 is illustrated as formed inside tube 12 evenly spaced from lower end 16, but could be formed such that it is unevenly spaced from lower end 16 if desired. Groove 22 can be formed by cutting into inside wall 18 or can be formed concurrently with the formation of tube 12. Groove 22 is preferably, but not necessarily, continuous, as it could be a series of discontinuous slots.

A bottom 30 is positioned in groove 22. In one embodiment, bottom 30 is a flexible disc having a diameter greater than that of inside wall 18, where the bottom is pushed and flexed to slide along surface 20 until it reaches groove 22 and expands into groove 22.

Bottom 30 is illustrated as having a convex surface 30*a*, which may have an irregular shape, a conical shape or, as illustrated, a hemispherical or dome shape. In the embodiment illustrated in FIG. 1, a chamber 32 is defined by cylindrical surface 20 of inside wall 18 and surface 30*a* of bottom 30.

In use, pyrotechnics or other explosive propellants are received in chamber 32. When the pyrotechnics are ignited and discharged, explosive force pushes down on bottom 30 in the direction illustrated by arrow 34. If bottom 30 is provided with a dome shape, as illustrated, the explosive force tends to flatten bottom 30, which presses it radially outwardly into groove 22. Thus, the explosive force is transmitted to tube 12. Since tube 12 is fabricated of a strong fiberglass reinforced polymer, it contains the explosive force.

Other shapes can be used for bottom 30, such as one having a convex surface and a hooked outer edge for engagement with tube 12 at groove 22, which can have a mating interlocking shape. This construction is more difficult and costly to make, but it provides interlocking engagement between bottom 30 and tube 12.

In the past, a flat plug or bottom has been bonded by an adhesive to an inside wall of an FRP tube to make a launch tube. However, the bond between the plug and the inside wall tends to break during discharge of pyrotechnics. Further, where an FRP plug is made in place and cured inside the tube, where the tube does not have a groove for receiving the plug, the FRP plug shrinks during curing, which tends to break the bond between the plug and the inside wall of the tube. In the present invention using groove 22, bottom 30 is sized so that it continues to engage tube 12 after curing and shrinking.

One end of a tube could be enclosed during formation of the tube, but this has historically been cost prohibitive. However, it is technically feasible, and the resulting bottom could have a concave surface for defining the interior chamber. In this case an outer sleeve could be placed about the tube to provide a squared-off end so that the tube can be easily placed in an upright position for discharge of pyrotechnics.

Figure 2:
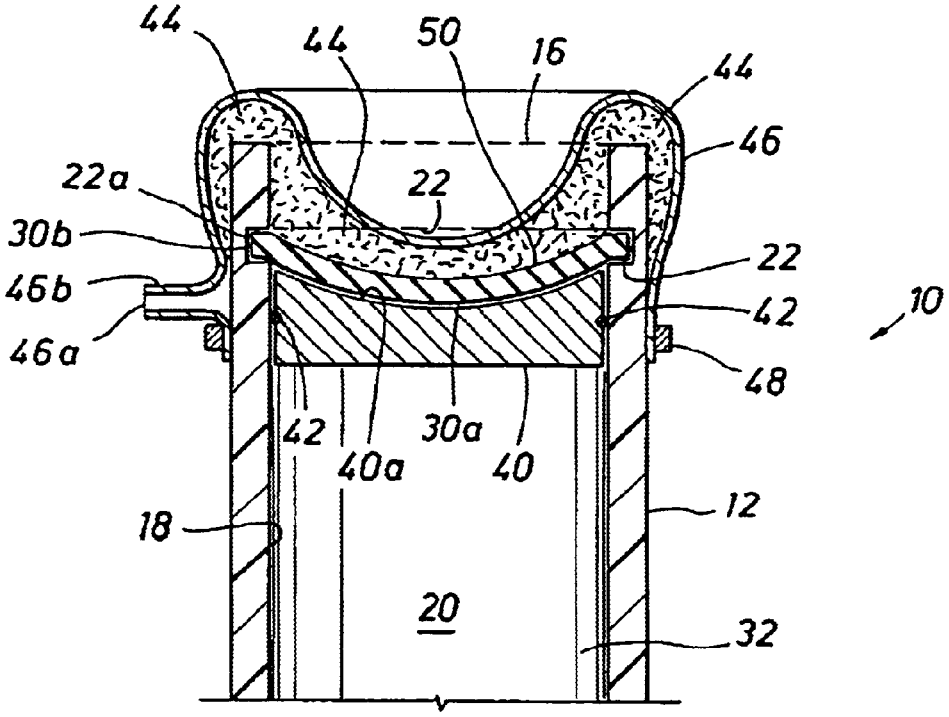
FIG. 2 is a cross section illustrating a method of making a launch tube according to the present invention.

Turning now to FIG. 2, a method and apparatus for making an FRP launch tube 10 is illustrated. Tube 12 has been turned upside down from the position shown in FIG. 1, and lower end 16 is now on top. A mold 40 having a concave surface 40*a* is placed inside tube 12 adjacent to groove 22. Mold 40 is preferably sealed with inside wall 18 of tube 12, such as by an O-ring 42. A release agent (not shown) is coated on mold 40 so that mold 40 can be subsequently removed.

Resin-coated fiberglass matting 50 is built up to a desired thickness on mold 40. Fibers can be laid in a desirable orientation, such as a cross hatch, and pressed into groove 22. When a desired thickness is built up, a layer of porous sheeting having the texture of a wax-coated nylon (not shown) can be laid on the fiberglass matting. This layer is not shown in FIG. 2 in order to simplify the drawing. A porous and fibrous material 44 is next placed over the fiberglass matting in lower end 16 of tube 12.

A nonporous sheet 46 is placed over fibrous material 44, and a clamp 48 compresses nonporous sheet 46 against tube 12, which seals the fiberglass matting within the lower end 16 of tube 12. The fiberglass matting 50 is thus sandwiched between mold 40 and porous material 44. Nonporous sheet 46 has an opening 46*a* and a tubular connection 46*b* for connection to a vacuum source (not shown).

The vacuum source, the equivalent of a vacuum cleaner, a vacuum pump, an aspirator or other suitable means, is connected to tubular connection 46*b*. A vacuum is drawn, which evacuates air, vapor and gas from the fiberglass matting 50 and from the porous material 44. Atmospheric pressure on the outside surface of nonporous sheet 46 compresses fibrous material 44 and the fiberglass matting 50, which causes the fiberglass matting 50 to extrude into groove 22. Fibrous material 44 is selected for allowing air, gas and/or vapor to pass out of the fiberglass matting and to the vacuum source through opening 46*a*. Fibrous material 44 may be a felt, an insulation or any other suitable material that allows air, gas and vapor to pass therethrough.

Nonporous sheet 46 thus forms a bag over lower end 16 of tube 12. The clamp 48 seals nonporous sheet 46 to an outer surface of tube 12. Clamp 48 may be an adhesive tape, mastic, a Velcro® strap, a belt, a pipe clamp or any suitable mechanism. O-ring 42 provides a seal between mold 40 and inside wall 18 of tube 12 as a vacuum is drawn through opening 46*a*.

Outside air pressure compresses the fiberglass matting 50 and tends to provide a uniform thickness of the fiberglass matting as well as engagement of the matting 50 within groove 22. Alternatively, a mold could be provided from lower end 16, and air pressure could be provided from upper end 14. In fact, tube 12 could be sealed at upper end 14, and pressure higher than atmospheric pressure could be used. Various shapes of the mold can be used to provide a bottom member of any desired shape and configuration. Although the fiberglass matting may shrink some during curing, bottom 30 is sized so that it continues to be engaged with tube 12 at groove 22 after curing. The depth of groove 22 thus provides room for contraction of the fiberglass matting as it cures.

Nonporous sheet 46 and clamp 48 are removed and the fiberglass matting is allowed to cure to form bottom 30. The rate of curing can be accelerated by heat, such as by placing the fiberglass matting under a heat lamp. Thus, bottom 30 is molded in place for engagement with tube groove 22 through an interengaging arrangement.

Turning tube 12 right side up from the position shown in FIG. 2, bottom 30 and lower end 16 are as shown in FIG. 1. Pyrotechnics, other explosive propellants or other desired matter can then be loaded in chamber 32. A launch tube is thus made of fiberglass reinforced polymeric material, where the bottom is molded in place and engaged with a groove in the inside wall of launch tube 12. A watertight seal can be provided by bottom 30, which prolongs the life of unused matter contained within chamber 32.

Figure 3:
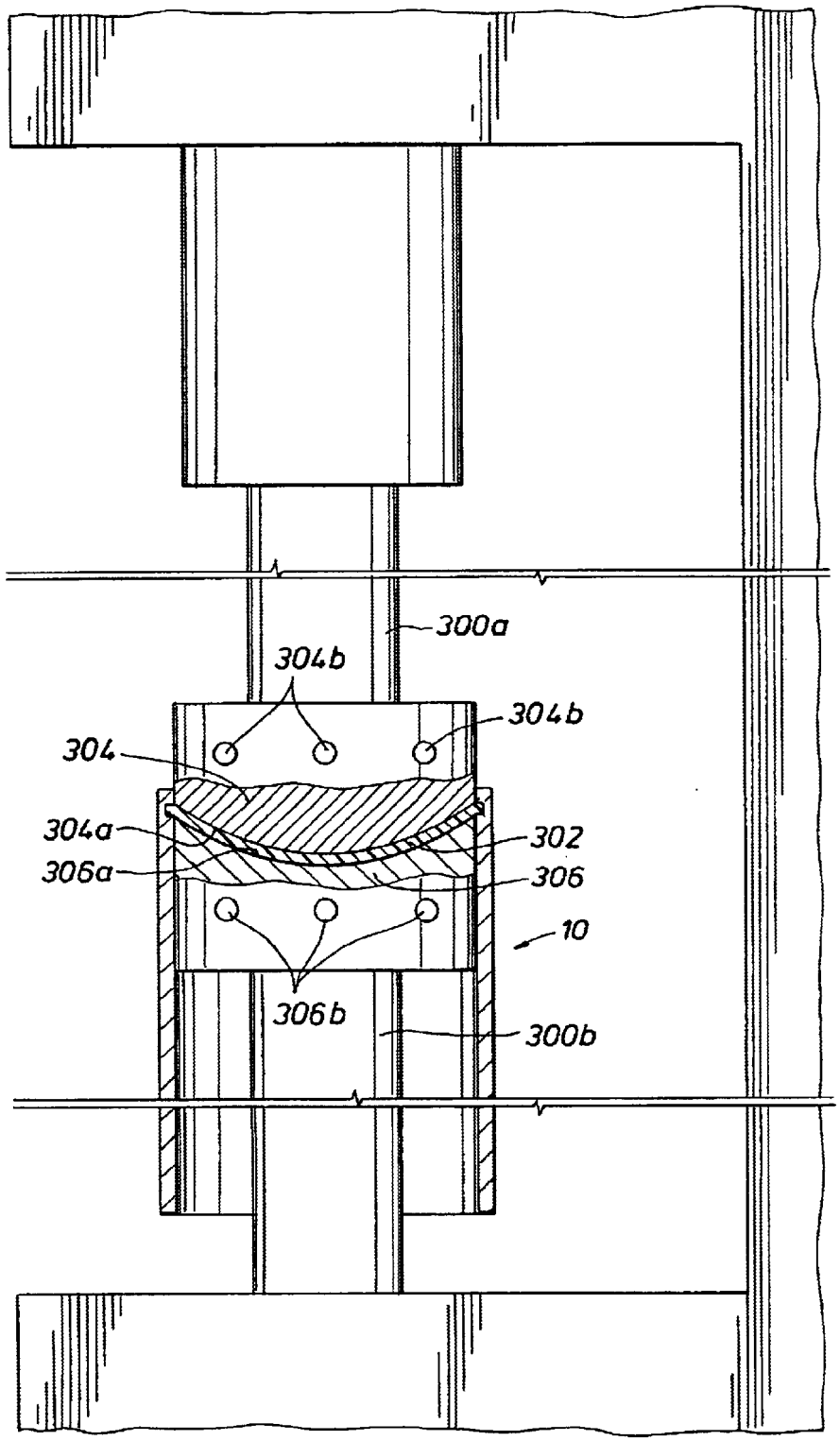
FIG. 3 is a cross section broken view illustrating another method of making a launch tube accordingly to the present invention.

In another embodiment, as shown in FIG. 3, counter-mold presses 300*a* and 300*b* are used to compress a compound, such as a resin 302, rather than the vacuum-setting process described above. The resin 302 used to make the bottom preferably comprises a molding compound, such as Sheet Molding Compound (SMC), Bulk Molding Compound (BMC) or Low Pressure Molding Compound (LPMC). The counter-mold 304 preferably has a convex surface 304*a* that corresponds in shape and size to the concave surface 306*a* of mold 306, and the resin 302 is between mold 306 and the counter-mold 304. As will be discussed below, mold 306 and counter-mold 304 are provided with a plurality of heating elements 306*b* and 304*b*, respectively. Force is applied to compress the resin 302, which expels air.

While the vacuum-setting process described with reference to FIG. 2 can achieve a maximum compressive force of atmospheric pressure, which is about 15 pounds per square inch (psi), the force applied in using counter-mold presses can be any desired force. The force may range between about 15 psi and about 300 psi, but typically is between about 50 psi and 150 psi, and is preferably about 100 psi when using LPMC. The LPMC is subjected to a temperature from the heating elements 304*b* and 306*b* in the range of 200 and 300° F., with a preferable temperature of 250° F.

When using SMC and BMC, the force applied typically range between 200 psi and 300 psi and preferably 250 psi. In addition, the SMC or BMC is subjected to a temperature from the heating elements 304*b* and 306*b* in the range of 250 to 350° F., with a preferable temperature of 300° F.

In all the above embodiments, the lightweight launch tube 10 is non-conductive electrically, which is desirable to prevent accidental discharge, non-corrosive, non-metallic and watertight. As explosive forces are encountered by bottom 30 during discharge of the pyrotechnics or other explosive propellants, forces are transmitted radially through bottom 30 and into tube 12, where the forces are contained by a reactive compressive force of tube 12.

An FRP launch tube is thus provided, which has a bottom engaged with the inside wall 18 of tube 12 at groove 22. Surface 30*a* is preferably convex, although it may be flat or even concave. As best shown in FIG. 2, all of the above embodiments result in a bottom 30 formed with an outer circumferential edge 30*b*, which engages a shoulder 22*a* formed by groove 22 in inside wall 18 of tube 12. Bottom 30 is thus firmly engaged with tube 12 with edge 30*b* engaged with shoulder 22*a*.

The foregoing disclosure and description of the invention are illustrative and explanatory thereof, and various changes in the details of the illustrated apparatus and construction and method of operation may be made without departing from the spirit of the invention.

We claim:

1. A method for making a launch tube, comprising:

forming a tube having an inside wall;

positioning a slot in the inside wall of the tube;

placing a mold inside the tube adjacent the slot;

laying a compound on the mold;

compressing the compound against the mold and into the slot;

and curing the compound.

2. The method of claim 1, wherein the step of compressing uses a counter-mold press.

3. The method of claim 1, wherein the compound is a Low Pressure Molding Compound.

4. The method of claim 1, wherein the step of compressing includes subjecting the compound to a pressure in the range of 200 psi to 300 psi.

5. The method of claim 1, further comprising the step of heating the compound to a temperature in the range of 250° F. to 350° F.

6. The method of claim 1, wherein the compound is a molding compound.

7. The method of claim 6, wherein the step of compressing includes subjecting the compound to a pressure in the range of 200 psi to 300 psi.

8. The method of claim 7, further comprising the step of heating the compound to a temperature in the range of 250° F. to 350° F.

9. The method of claim 2, wherein the compound is a molding compound.

10. The method of claim 9, wherein the step of compressing includes subjecting the compound to a pressure in the range of 50 psi to 150 psi.

11. The method of claim 10, further comprising the step of heating the compound to a temperature in the range of 200° F. to 300° F.

12. The method of claim 1, wherein the mold has a concave surface.

13. The method of claim 1, wherein the cured compound has a relatively uniform thickness.

14. The method of claim 1, wherein the slot is a groove in the inside wall of the tube.

15. The method of claim 1, wherein the tube is formed from a fiberglass reinforced polymer.

16. The method of claim 1, wherein the compound is a Sheet Molding Compound.

17. The method of claim 16, wherein the step of compressing includes subjecting the compound to a pressure in the range of 200 psi to 300 psi.

18. The method of claim 17, further comprising the step of heating the compound to a temperature in the range of 250° F. to 350° F.

19. The method of claim 1, wherein the compound is a Bulk Molding Compound.

20. The method of claim 19, wherein the step of compressing includes subjecting the compound to a pressure in the range of 200 psi to 300 psi.

21. The method of claim 20, further comprising the step of heating the compound to a temperature in the range of 250° F. to 350° F.

22. The method of claim 2, wherein the compound is a Low Pressure Molding Compound.

23. The method of claim 22, wherein the step of compressing includes subjecting the compound to a pressure in the range of 50 psi to 150 psi.

24. The method of claim 23, further comprising the step of heating the compound to a temperature in the range of 200° F. to 300° F.

* * * * *